US008721366B2

(12) United States Patent
Yamaji et al.

(10) Patent No.: US 8,721,366 B2
(45) Date of Patent: May 13, 2014

(54) CONNECTOR

(75) Inventors: Takahiro Yamaji, Tokyo (JP); Takamitsu Nakajima, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/558,591

(22) Filed: Jul. 26, 2012

(65) Prior Publication Data

US 2013/0196546 A1 Aug. 1, 2013

(30) Foreign Application Priority Data

Feb. 1, 2012 (JP) ..... 2012-020182

(51) Int. Cl.
*H01R 9/03* (2006.01)

(52) U.S. Cl.
USPC ..... 439/607.4

(58) Field of Classification Search
USPC ..... 439/607.35, 607.36, 607.4
See application file for complete search history.

(56) References Cited

U.S. PATENT DOCUMENTS

D626,511 S * 11/2010 Nakajima et al. ..... D13/147
7,934,957 B1 * 5/2011 Nakajima et al. ..... 439/607.49
8,235,736 B2 * 8/2012 Watanabe et al. ..... 439/108
D688,207 S * 8/2013 Nakajima et al. ..... D13/147
D688,209 S * 8/2013 Nakajima et al. ..... D13/147
2012/0003866 A1 * 1/2012 Yamaji ..... 439/527
2012/0009821 A1 * 1/2012 Watanabe et al. ..... 439/626
2013/0196546 A1 * 8/2013 Yamaji et al. ..... 439/629

FOREIGN PATENT DOCUMENTS

JP 2006-172824 A 6/2006
JP 2011-119152 A 6/2011
JP 2011-159598 A 8/2011

* cited by examiner

*Primary Examiner* — James Harvey
(74) *Attorney, Agent, or Firm* — Holtz, Holtz, Goodman & Chick, PC

(57) ABSTRACT

A connector is mountable on a circuit board and matable with a mating connector having a mating portion and a mating shell. The connector comprises a housing and a shell. The housing is formed with a receiving portion. The receiving portion is receives the mating portion of the mating connector when the mating portion is inserted into the connector. The shell has a plurality of first connected portions and a plurality of second connected portions. The first connected portions are configured to be connected to the mating shell of the mating connector when the connector and the mating connector are mated with each other. The second connected portions are configured to be connected to the circuit board when the connector is mounted on the circuit board. The first connected portions and the second connected portions extend forward of the receiving portion.

10 Claims, 6 Drawing Sheets

CONNECTOR

CROSS REFERENCE TO RELATED APPLICATIONS

Applicants claim priority under 35 U.S.C. §119 of Japanese Patent Application No. JP2012-020182 filed Feb. 1, 2012.

BACKGROUND OF THE INVENTION

This invention relates to a connector mountable on a circuit board and matable with a mating connector.

Generally, this type of connector has means to reduce electromagnetic interference (EMI). More specifically, the connector comprises a shell which is provided with a first connected portion (connected portion) and a second connected portion (connected portion). The first connected portion is configured to be connected to a mating shell of the mating connector. The second connected portion is configured to be connected to the circuit board. The mating shell and the circuit board are electrically connected with each other via the shell when the connector and the mating connector are mated with each other so that the EMI is reduced.

For example, the aforementioned connector is disclosed in JP-A 2006-172824, JP-A 2011-159598 or JP-A 2011-119152, contents of which are incorporated herein by reference.

The connector of JP-A 2006-172824 comprises a shell and a receiving portion. The receiving portion is configured to receive a mating portion of a mating connector. The shell has a first connected portion provided in the receiving portion and a second connected portion provided below the receiving portion.

The connector of JP-A 2011-159598 comprises a shell and a receiving portion. The receiving portion is configured to receive a mating portion of a mating connector. The shell has a first connected portion provided in the receiving portion and a second connected portion projecting forward of the receiving portion.

The connector of JP-A 2011-119152 comprises a housing, a shell and a receiving portion. The receiving portion is configured to receive a mating portion of a mating connector. The shell has a first connected portion provided in the receiving portion and a second connected portion provided under a bottom surface of the housing. The first connected portion and the second connected portion are arranged in a mating direction.

However, as for the aforementioned connectors, the first connected portion is provided in the receiving portion so that it is difficult to make a size in an upper-to-lower direction of the receiving portion small. In other words, none of the aforementioned connectors has a structure which easily enables the connector to have a reduced height.

SUMMARY OF THE INVENTION

It is therefore an object of the present invention to provide a connector having a structure which enables the connector to have a reduced height, wherein the connector has a first connected portion configured to be connected to a mating shell of a mating connector and a second connected portion configured to be connected to a circuit board.

One aspect of the present invention provides a connector mountable on a circuit board and matable with a mating connector having a mating portion and a mating shell. The connector comprises a receiving portion, a plurality of contacts, a housing and a shell. The receiving portion is receivable the mating portion of the mating connector when the mating portion is inserted into the connector toward a rear end in a front-to-rear direction of the connector. The housing has a holding portion and two end portions. The holding portion holds the contacts so that the contacts are arranged in a pitch direction perpendicular to the front-to-rear direction. The holding portion has an upper portion and a lower portion in an upper-to-lower direction perpendicular to both the front-to-rear direction and the pitch direction. The upper portion and the lower portion constitute at least a part of the receiving portion. The end portions are located at opposite ends of the holding portion in the pitch direction, respectively. The shell has an upper plate portion, a lower plate portion and a plurality of connected portions. The upper plate portion is located at the upper portion of the housing. The lower plate portion is located at the lower portion of the housing. The connected portions consist of a plurality of first connected portions and a plurality of second connected portions. The first connected portions are configured to be connected to the mating shell of the mating connector when the connector and the mating connector are mated with each other. The second connected portions are configured to be connected to the circuit board when the connector is mounted on the circuit board. The first connected portions and the second connected portions extend forward from the lower plate portion beyond the upper portion.

An appreciation of the objectives of the present invention and a more complete understanding of its structure may be had by studying the following description of the preferred embodiment and by referring to the accompanying drawings.

Figure 1:
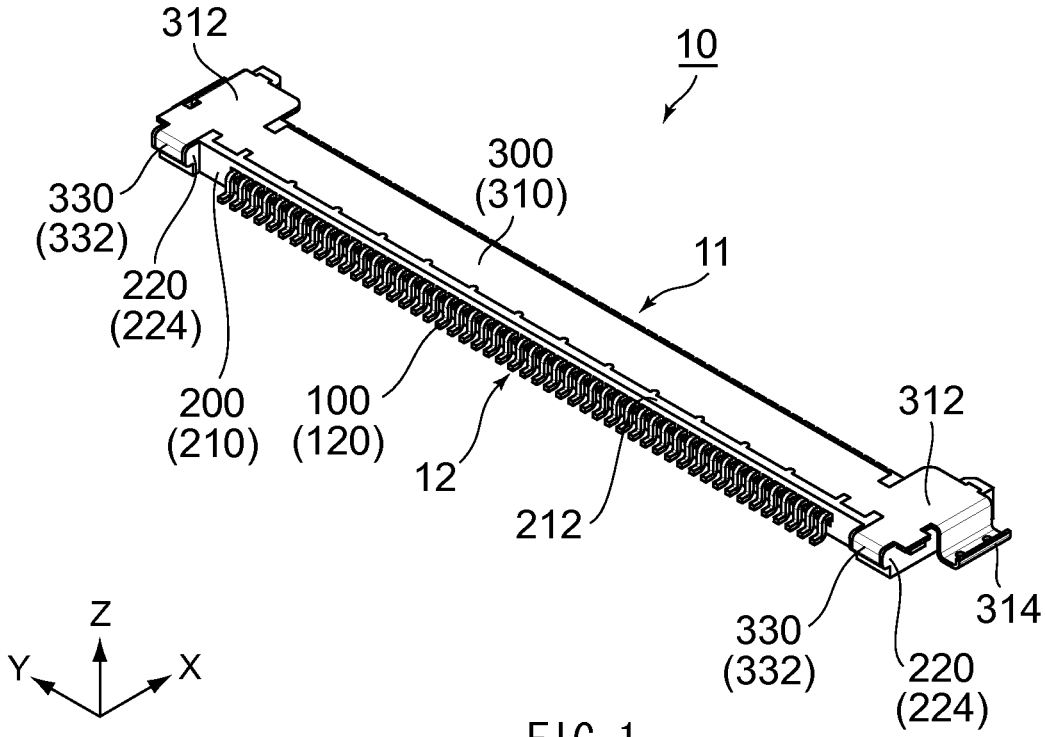
FIG. 1 is a rear, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 8:
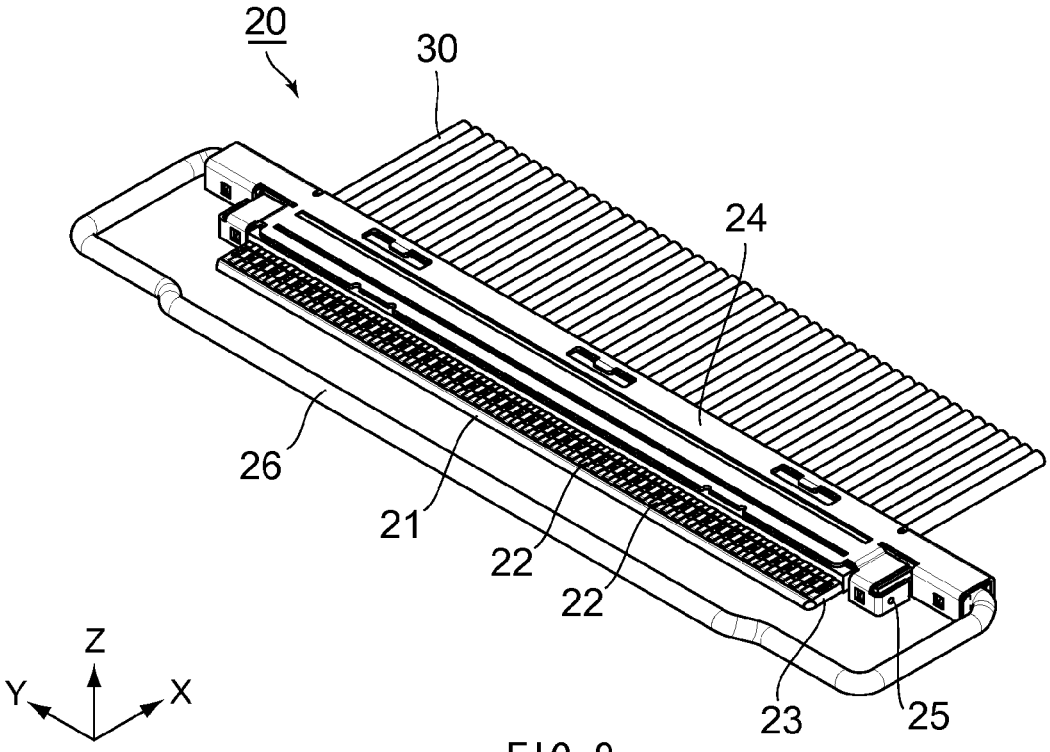
FIG. 8 is a top, perspective view showing a mating connector matable with the connector of FIG. 1.
Figure 9:
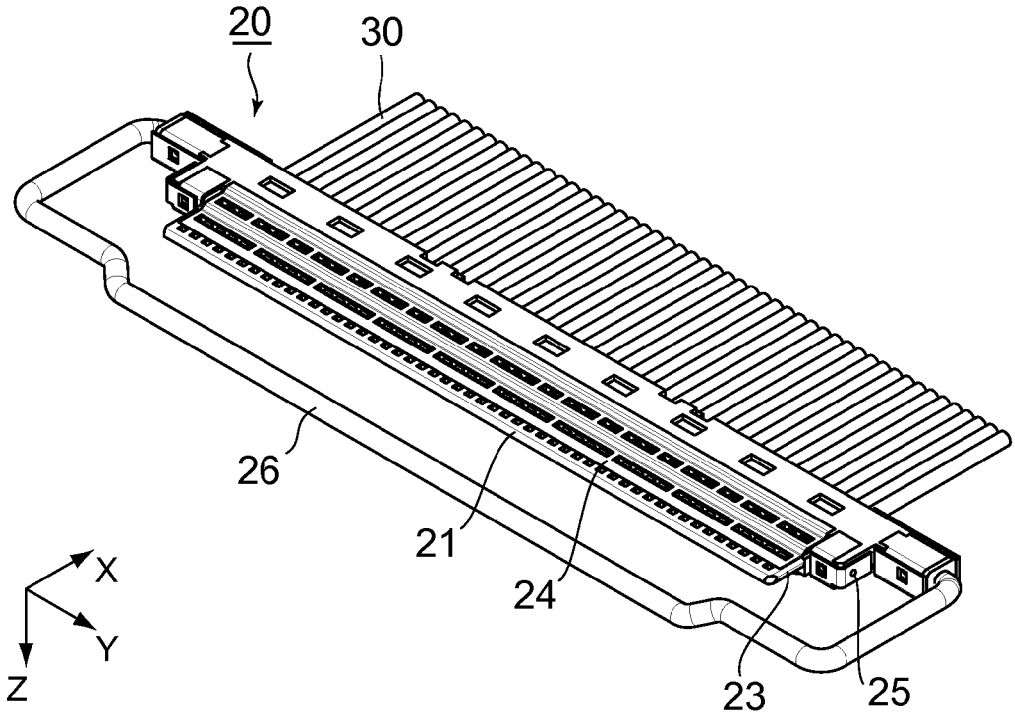
FIG. 9 is a bottom, perspective view showing the mating connector of FIG. 8.

Referring to FIGS. 1 to 7, a connector 10 according to an embodiment of the present invention comprises a plurality of contacts 100 each made of a conductive material, a housing 200 made of an insulating material and a shell 300 made of a metal. The connector 10 has a front end 11 and a rear end 12 on opposite ends in a front-to-rear direction (X-direction), respectively. The connector 10 further comprises a receiving portion 13. The receiving portion 13 is a space which is formed within the connector 10 so as to open at the front end 11 of the connector 10. The connector 10 is configured to be mounted on and fixed to a circuit board (not shown). As shown in FIGS. 8 and 9, the connector 10 is configured to be mated with and connected to a mating connector 20. In other words, the connector 10 is mountable on the circuit board (not shown) and matable with the mating connector 20. The connector 10 and the mating connector 20 are mated with each other so that a connector assembly is formed.

Figure 11:
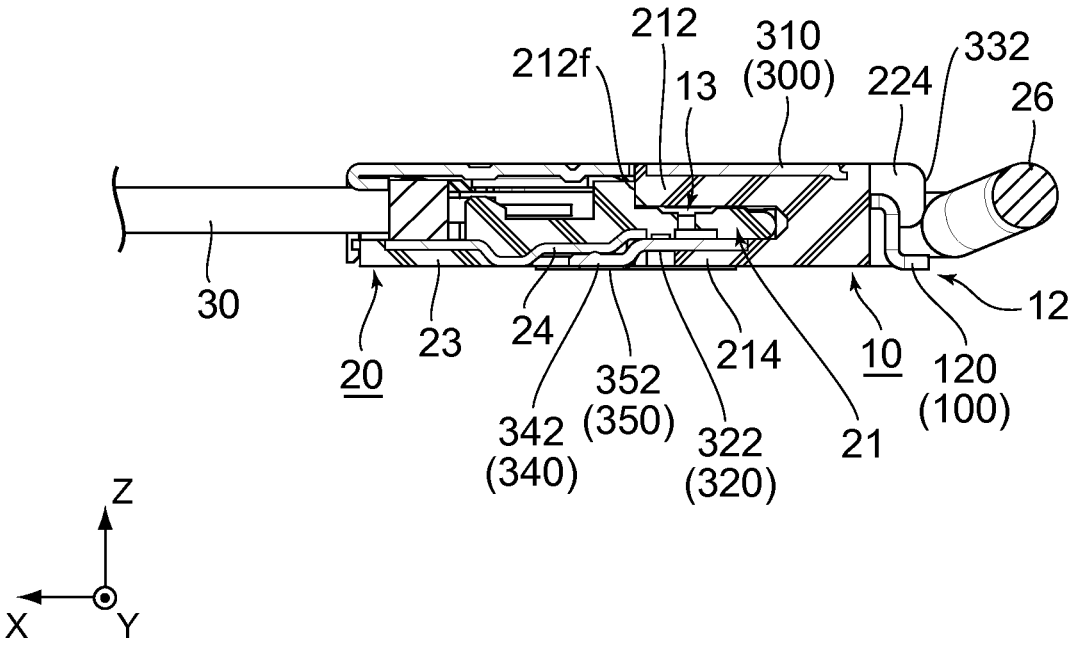
FIG. 11 is a cross-sectional view showing the connector assembly of FIG. 10, taken along lines XI-XI.

Referring to FIGS. 8 and 9, the mating connector 20 according to the present embodiment is a cable connector which is attachable to a cable 30. The mating connector 20 has a mating portion 21. As shown in FIG. 11, the mating portion 21 is inserted into and received by the receiving portion 13 of the connector 10 when the connector 10 and the mating connector 20 are mated with each other. In detail, the mating portion 21 is inserted into the receiving portion 13 toward the rear end 12 of the connector 10 in the front-to-rear direction (i.e. inserted along the negative X-direction). In other words, the receiving portion 13 is receivable the mating portion 21 of the mating connector 20 when the mating portion 21 is inserted into the connector 10 toward the rear end 12 in the front-to-rear direction of the connector 10. The mating connector 20 comprises a plurality of mating contacts 22 each made of a conductive material, a mating housing 23 made of an insulating material, a mating shell 24 made of a metal and a lock-bar 26 made of a metal. The mating housing 23 has a plate-like portion which constitutes the mating portion 21. The mating contacts 22 are arranged to be exposed on an upper surface of the plate-like portion (i.e. mating portion 21). The mating shell 24 has two engaging protrusions 25. The engaging protrusions 25 are provided on opposite ends in the Y-direction (pitch direction perpendicular to the front-to-rear direction) of the mating shell 24, respectively. Each of the engaging protrusions 25 bulges outward in the pitch direction (Y-direction).

Figure 4:
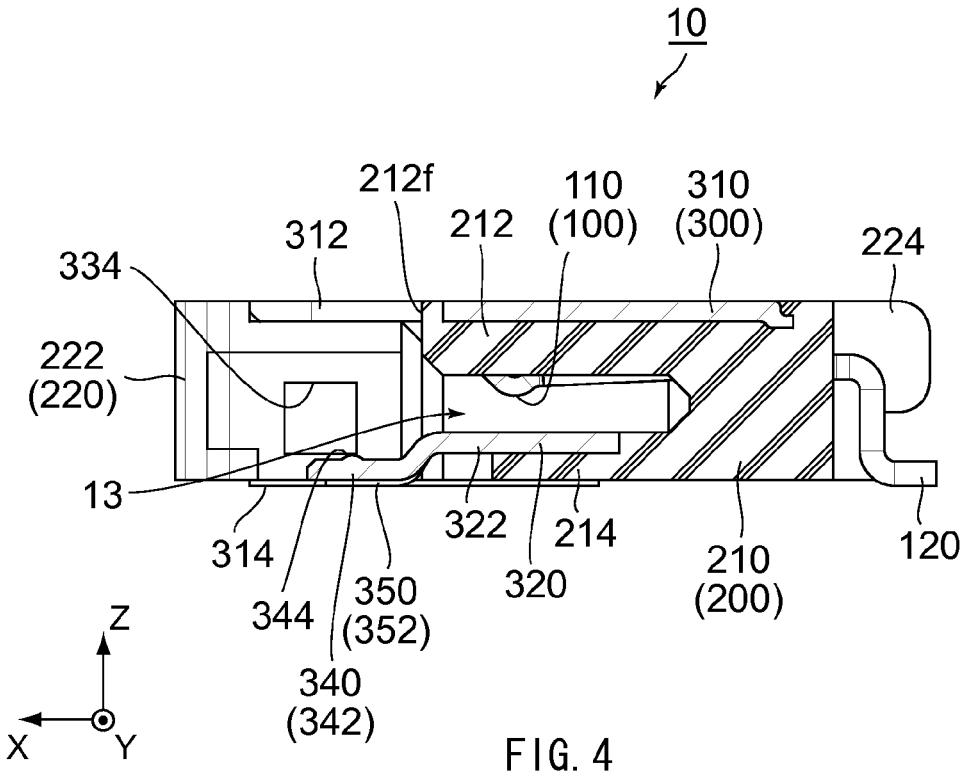
FIG. 4 is a cross-sectional view showing the connector of FIG. 2, taken along lines IV-IV.
Figure 5:
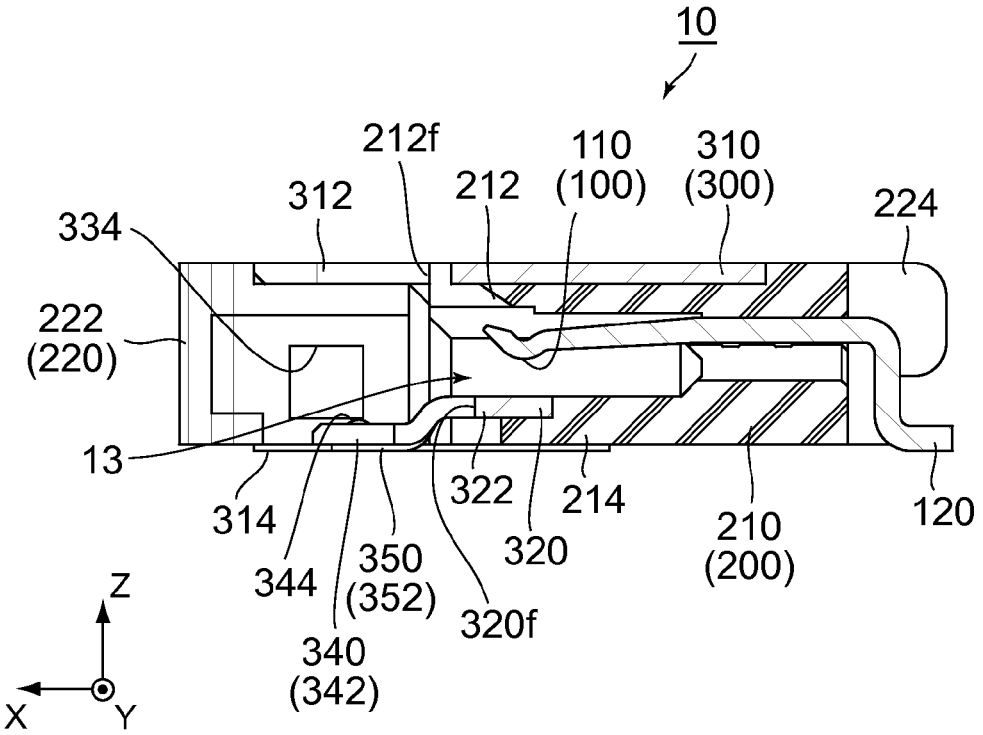
FIG. 5 is a cross-sectional view showing the connector of FIG. 2, taken along lines V-V.

As shown in FIGS. 1, 4 and 5, each of the contacts 100 has a contact portion 110 and a fixed portion 120. The contact portion 110 is located in the receiving portion 13. The fixed portion 120 is configured to be fixed to the circuit board (not shown) by soldering, for example. The contacts 100 according to the present embodiment are press-fitted in and held by the housing 200. However, the contacts 100 may be held by the housing 200 in a different manner. For example, the contacts 100 may be embedded in the housing 200 by insert-molding.

Figure 2:
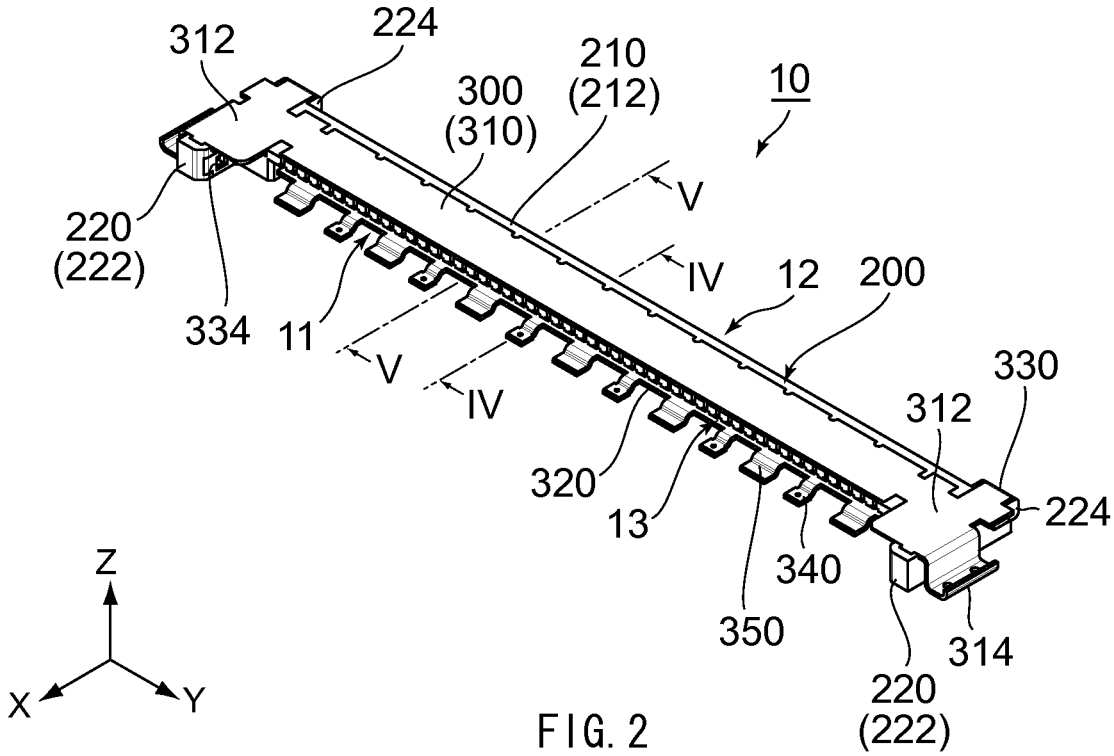
FIG. 2 is a front, perspective view showing the connector of FIG. 1.
Figure 6:
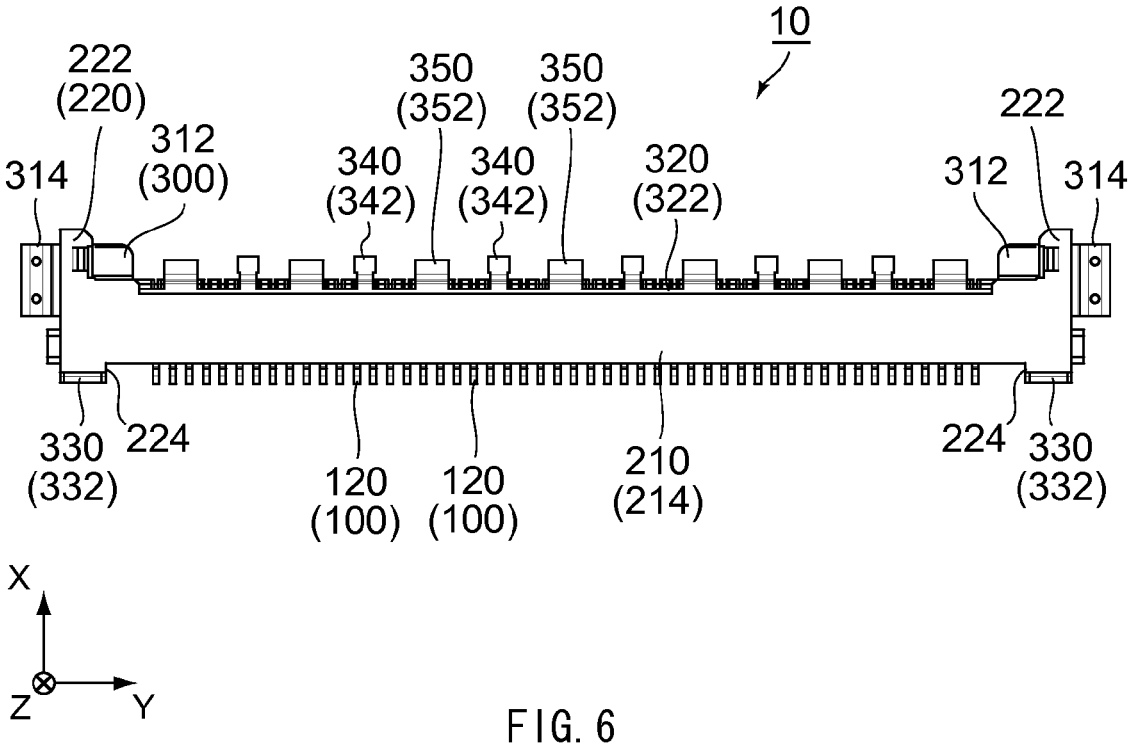
FIG. 6 is a bottom view showing the connector of FIG. 1.

As shown in FIGS. 1, 2 and 6, the housing 200 has a holding portion 210 and two end portions 220. The holding portion 210 holds the contacts 100 so that the contacts 100 are arranged in the pitch direction (Y-direction). The end portions 220 are located at opposite ends of the holding portion 210 in the pitch direction, respectively.

As shown in FIGS. 4 and 5, the holding portion 210 has an upper portion 212 and a lower portion 214 in the Z-direction (upper-to-lower direction perpendicular to both the front-to-rear direction and the pitch direction). According to the present embodiment, the upper portion 212 and the lower portion 214 form a part of the receiving portion 13. However, the upper portion 212 and the lower portion 214 may form the whole of the receiving portion 13.

Figure 3:
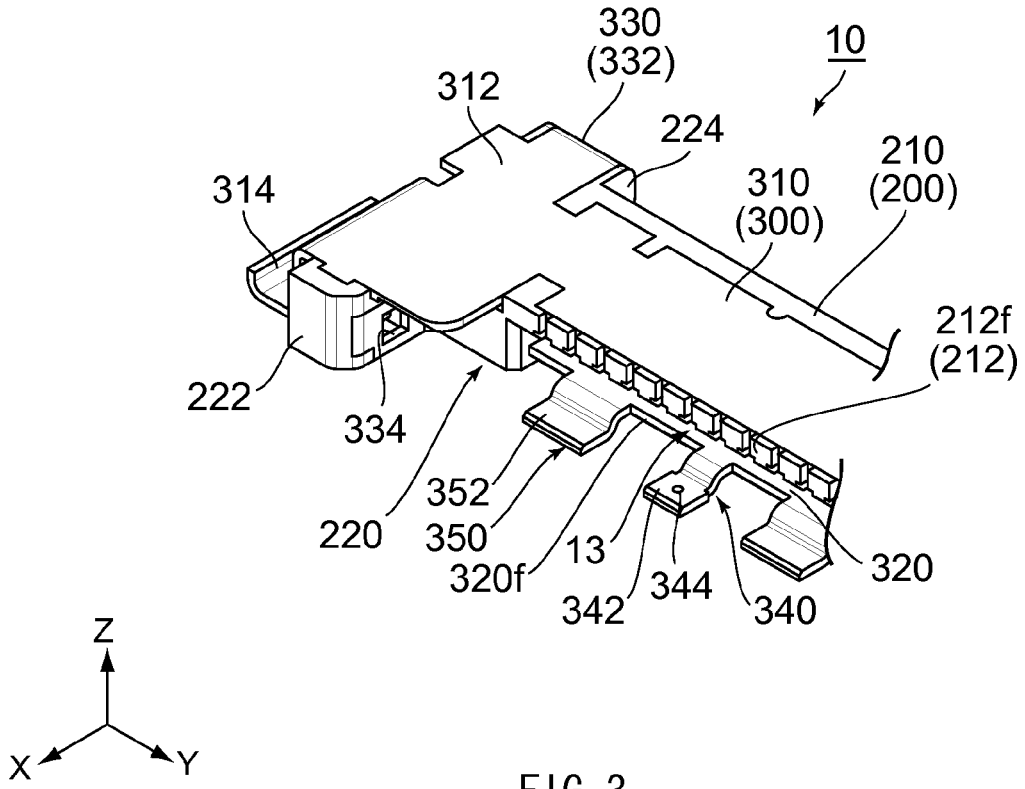
FIG. 3 is a partially enlarged, perspective view showing the connector of FIG. 2.

As shown in FIGS. 3 to 5, each of the end portions 220 has a forward protruding portion 222 and a rearward protruding portion 224. The forward protruding portion 222 protrudes forward (i.e. in the positive X-direction) beyond the holding portion 210. The rearward protruding portion 224 protrudes rearward (i.e. in the negative X-direction) beyond the holding portion 210. According to the present embodiment, a length of the end portion 220 in the front-to-rear direction is longer than a length of the holding portion 210 in the front-to-rear direction. Moreover, a protruding amount (i.e. a length in the front-to-rear direction) of the forward protruding portion 222 is larger than a protruding amount of the rearward protruding portion 224.

As shown in FIGS. 1 to 7, the shell 300 according to the present embodiment is embedded in the housing 200 by insert-molding so that the shell 300 and the housing 200 are integrated. The shell 300 and the housing 200 may be configured differently. For example, the shell 300 may be attached to the housing 200 by press-fitting after the housing 200 is molded. However, in order to reduce a height of the connector 10, it is preferred that the shell 300 be embedded into the housing 200 by insert-molding while the housing 200 is molded.

As shown in FIGS. 1 to 7, the shell 300 has an upper plate portion 310, a lower plate portion 320, two coupling portions 330 and a plurality of connected portions 340 and 350. The upper plate portion 310 is located at the upper portion 212 of the holding portion 210 (i.e. housing 200). The lower plate portion 320 is located at the lower portion 214 of the holding portion 210. The coupling portions 330 are located at opposite ends in the pitch direction of the shell 300. Each of the coupling portions 330 couples the upper plate portion 310 and the lower plate portion 320 with each other. The connected portions 340 and 350 consist of a plurality of first connected portions 340 and a plurality of second connected portions 350.

As shown in FIGS. 1 to 3, the upper plate portion 310 partially covers the upper portion 212 of the holding portion 210. The holding portion 210 has a front surface **212*f* in the front-to-rear direction. The upper plate portion 310 is located rearward of the front surface 212*f* of the holding portion 210. In other words, the front surface 212*f* of the holding portion 210 is located forward of the upper plate portion 310 in the front-to-rear direction. The upper plate portion 310 has two upper-outer portions 312 on opposite ends thereof in the pitch direction, respectively. Each of the upper-outer portions 312 covers an upper side of the end portion 220. The upper plate portion 310 further has two hold-downs 314. Each of the hold-downs 314 is provided at an outer side of the upper-outer portion 312 in the pitch direction. The hold-downs 314** are configured to be fixed to the circuit board (not shown) by soldering, for example.

As shown in FIGS. 3 to 7, the lower plate portion 320 is embedded in the lower portion 214 of the holding portion 210 so that a part of the lower plate portion 320 is exposed in the receiving portion 13. The lower plate portion 320 according to the present embodiment faces the contact portions 110 of the contacts 100 in the upper-to-lower direction (Z-direction). When the connector 10 and the mating connector 20 are mated with each other, the mating portion 21 is inserted between the contact portions 110 of the contacts 100 and the lower plate portion 320.

Figure 7:
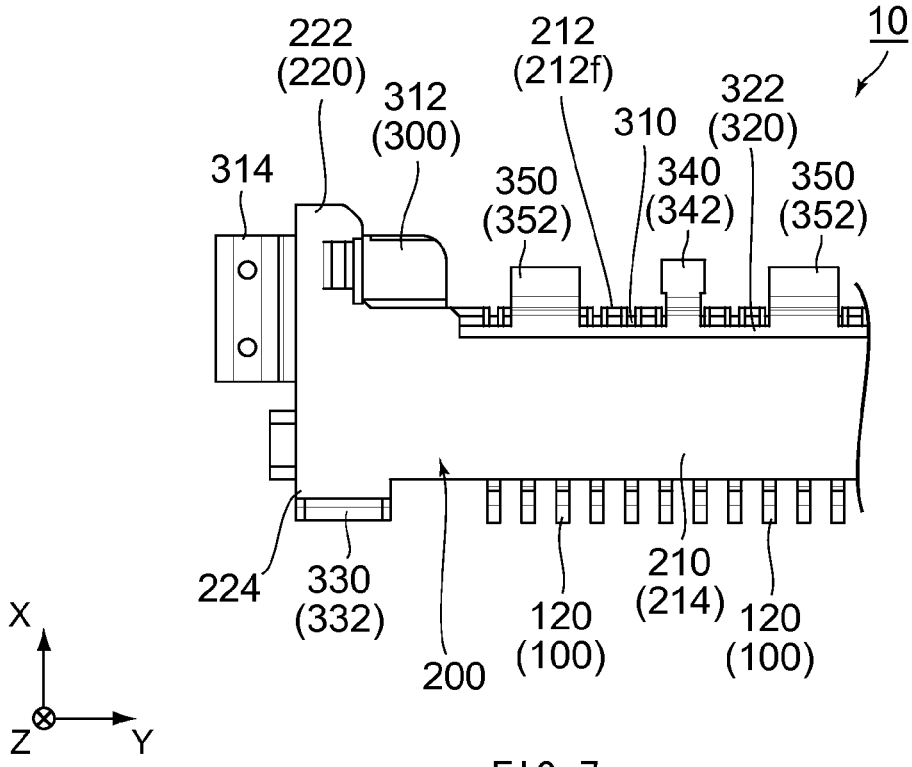
FIG. 7 is a partially enlarged, bottom view showing the connector of FIG. 6.

As shown in FIGS. 6 and 7, the lower plate portion 320 has a front end part 322 formed on a bottom surface thereof. The front end part 322 extends in the pitch direction. The lower portion 214 of the holding portion 210 is located rearward of the front end part 322. The front end part 322 is not covered by the lower portion 214. Accordingly, the front end part 322 is visible from below (i.e. from the negative Z-side of the connector 10).

Figure 10:
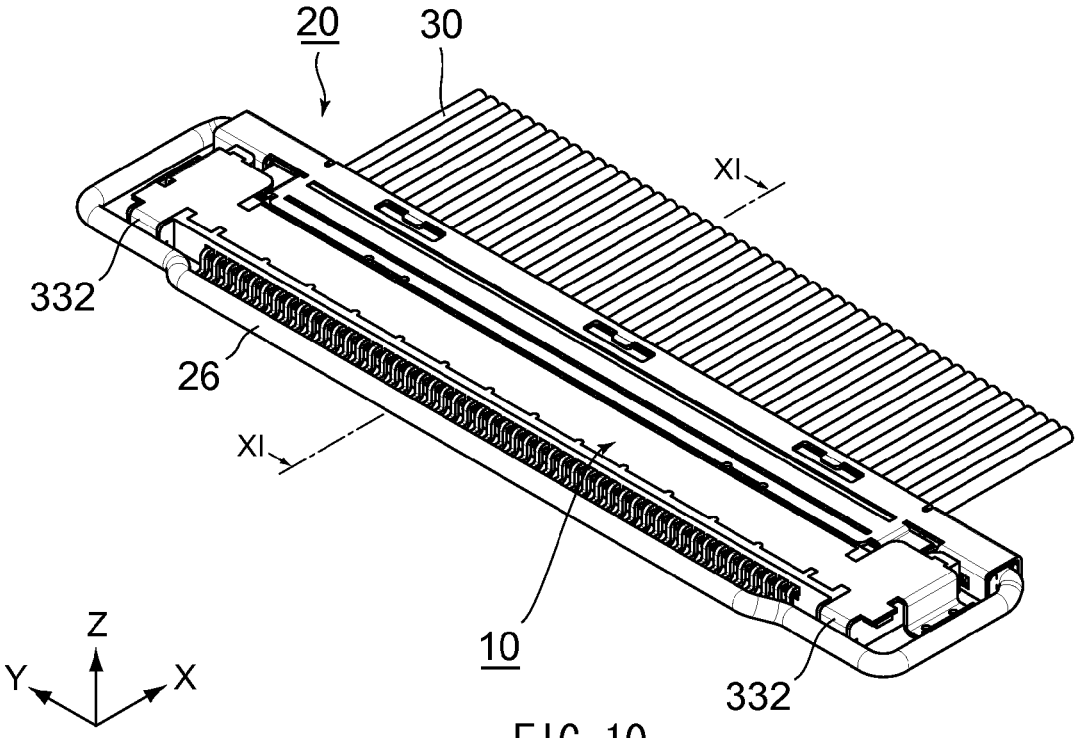
FIG. 10 is a perspective view showing a connector assembly comprising the connector of FIG. 1 and the mating connector of FIG. 8, wherein the connector and the mating connector are mated with each other.

As shown in FIGS. 1 to 3, 6 and 7, the coupling portion 330 has a locked portion 332 and an engaging hole 334. The most part of the coupling portion 330, except the locked portion 332, the engaging hole 334 and their peripheral parts, is buried within the housing 200. As shown in FIGS. 1, 6 and 7, the locked portion 332 is exposed on the rearward protruding portion 224 of the housing 200. As can be seen from FIGS. 10 and 11, the locked portion 332 is configured to keep a mated state where the connector 10 and the mating connector 20 are mated with each other. More specifically, when the lock-bar 26 is turned, the locked portion 332 and the lock-bar 26 are brought into contact with and pressed against each other so that the mated state is maintained. As shown in FIGS. 2 and 3, the engaging hole 334 is located on an inner-side wall of the forward protruding portion 222. According to the present embodiment, the forward protruding portion 222 is provided with a hole corresponding to the engaging hole 334. However, the forward protruding portion 222 may have a structure which is different from the present embodiment. For example, the forward protruding portion 222 may not be provided with the hole. The engaging hole 334 is engaged with the engaging protrusion 25 of the mating connector 20 under the mated state. According to the present embodiment, the lock-bar 26 is brought into contact with and pressed against the locked portion 332 while the engaging protrusion 25 is engaged with the engaging hole 334 so that the mated state is more securely maintained.

The first connected portions 340 and the second connected portions 350 project forward from the lower plate portion 320. Especially, according to the present embodiment, all of the first connected portions 340 and the second connected portions 350 extend forward from the lower plate portion 320 beyond the upper portion 212 of the holding portion 210 in the front-to-rear direction. In other words, the first connected portions 340 and the second connected portions 350 extend forward of the receiving portion 13 (i.e. extend to the outside of the receiving portion 13). It is therefore possible to form the first connected portions 340 and the second connected portions 350 even if the shell 300 (especially, the lower plate portion 320) is embedded in the housing 200 by insert-molding. According to the present embodiment, the first connected portions 340 and the second connected portions 350 are configured as described above so that it is possible to reduce the height of the connector 10. As shown in FIG. 5, the lower plate portion 320 has a front surface 320*f* in the front-to-rear direction. The front surface 320*f* of the lower plate portion 320 according to the present embodiment is located rearward of the front surface 212*f* of the upper portion 212. The first connected portions 340 and the second connected portions 350 extend forward of the upper portion 212 from the front surface 320*f* of the lower plate portion 320 beyond the front surface 212*f* of the upper portion 212.

As can be seen from FIGS. 2 and 6, all of the first connected portions 340 and the second connected portions 350 are located rearward of a front end of the end portion 220 (i.e. rearward of the front end of the forward protruding portion 222) in the front-to-rear direction. Especially, the first connected portions 340 and the second connected portions 350 according to the present embodiment are located rearward of a front end of the upper-outer portion 312 of the shell 300. Accordingly, as shown in FIG. 11, all of the first connected portions 340 and the second connected portions 350 are located under the mating connector 20 when the connector 10 is mated with the mating connector 20. As can be seen from FIG. 10, when a connector assembly (i.e. the connector 10 and the mating connector 20 under the mated state) according to the present embodiment is seen from above, the first connected portions 340 and the second connected portions 350 are invisible.

The first connected portions 340 are configured to be brought into contact with and connected to the mating shell 24 of the mating connector 20 under the mated state (i.e. when the connector 10 and the mating connector 20 are mated with each other). The second connected portions 350 are configured to be connected to a ground portion (not shown) of the circuit board (not shown) on which the connector 10 is mounted. For example, the second connected portions 350 are configured to be soldered to the ground portion (not shown). In other words, the second connected portions 350 are electrically connected to the ground portion (not shown) when the connector 10 is mounted on the circuit board (not shown). Accordingly, the mating shell 24 is electrically connected to the ground portion (not shown) of the circuit board (not shown) via the shell 300 when the connector assembly under the mated state is mounted on the circuit board (not shown).

As shown in FIGS. 2 and 6, all of the first connected portions 340 and the second connected portions 350 are arranged in a single row in the pitch direction. The first connected portions 340 are arranged to intermingle with the second connected portions 350 along the pitch direction. In addition, both neighboring connected portions 340 and 350 of the first connected portion 340 in the pitch direction are the second connected portions 350. Especially, the first connected portions 340 and the second connected portions 350 according to the present embodiment are arranged in the single row and alternately in the pitch direction. Accordingly, it is possible to shorten an electrical path between the first connected portion 340 and the second connected portion 350. Moreover, it is possible to provide a lot of the aforementioned short electrical paths. It is possible to form the short electrical path when at least one of the both neighboring connected portions 340 and 350 of the first connected portion 340 in the pitch direction is the second connected portion 350. However, it is preferred that the first connected portions 340 and the second connected portions 350 be arranged alternately in the pitch direction like the present embodiment in order to form more electrical paths. The first connected portion 340 and the second connected portion 350 may be formed at different positions in the front-to-rear direction, provided that the first connected portions 340 and the second connected portions 350 are intermingled in the pitch direction. For example, the first connected portions 340 and the second connected portions 350 may be arranged in a zigzag pattern. However, it is preferred that the first connected portions 340 and the second connected portions 350 be arranged in a row in the pitch direction like the present embodiment in order to shorten the electrical path extending from the first connected portion 340 to the second connected portion 350 as possible.

As can be seen from FIGS. 2 and 6, the outermost of a row of the first connected portions 340 and the second connected portions 350 is the second connected portion 350. According to the present embodiment, two of the second connected portions 350 are outermost connected portions which located at opposite ends of the row of the first connected portions 340 and the second connected portions 350, respectively. All of the first connected portions 340 are located between the two outermost connected portions in the pitch direction. As can be seen from FIGS. 6 and 7, only the first connected portions 340 and the second connected portions 350 are located forward of the upper portion 212 of the holding portion 210 between the outermost connected portions. As described above, according to the present embodiment, the two outermost connected portions consist of the second connected portions 350. However, the outermost connected portions may consist of the first connected portions 340. Moreover, one of the outermost connected portions may be the first connected portion 340 while a remaining one of the outermost connected portions is the second connected portion 350.

As shown in FIGS. 3 to 5, the first connected portion 340 and the second connected portion 350 have a first body portion 342 and a second body portion 352, respectively. Each of the first body portion 342 and the second body portion 352 has a flat-board like shape. As shown in FIGS. 3 to 5, both the first body portion 342 and the second body portion 352 are located below the lower plate portion 320. Accordingly, when the housing 200 is molded, it is possible to form the first connected portions 340 and the second connected portions 350 without interfering the metal mold which forms the receiving portion 13.

As shown in FIGS. 4 and 5, the first connected portion 340 according to the present embodiment is configured to be moved downward under the mated state. More specifically, the first connected portion 340 and the second connected portion 350 are configured so that the first body portion 342 is located above the second body portion 352 under an unmated state where the connector 10 and the mating connector 20 are separated from each other. As shown in FIGS. 3 to 5, the first body portion 342 is provided with a protrusion 344 protruding upward (i.e. protruding in the positive Z-direction). The protrusion 344 is brought into contact with the mating shell 24 when the connector 10 is mated with the mating connector 20 so that the first body portion 342 is moved downward (i.e. moved in the negative Z-direction) by the size of the protrusion 344. When the first body portion 342 is moved, the first connected portion 340 shows resilience. More specifically, the first connected portion 340 presses the protrusion 344 against the mating shell 24 by its resilience so that the electrical connection between the shell 300 and the mating shell 24 becomes more securely.

As shown in FIGS. 6 and 7, a size of the first connected portion 340 in the pitch direction (i.e. a width of the first connected portion 340) is smaller than a size of the second connected portion 350 in the pitch direction (i.e. a width of the second connected portion 350). The second connected portion 350 has a wide width so that it is possible to improve the ground connection between the second connected portion 350 and the circuit board (not shown). The first connected portion 340 has a narrow width so that it is possible to improve the resilience of the first connected portion 340. It is therefore possible to increase the contact reliability of the first connected portion 340 and the mating shell 24.

This invention is not limited to the aforementioned embodiment. The connector 10 may have various shapes or structures (i.e. may be modified variously). For example, a few modifications of the aforementioned embodiment are described below.

The end portion 220 of the housing 200 according to the aforementioned embodiment is longer than the holding portion 210 in the front-to-rear direction. However, the end portion 220 and the holding portion 210 may be formed differently. For example, a length of the end portion 220 in the front-to-rear direction may be nearly equal to a length of the holding portion 210 in the front-to-rear direction.

According to the aforementioned embodiment, the mating connector 20 is a cable connector. However, the mating connector 20 is not limited to a cable connector. The mating connector 20 may have any structures provided that the mating connector 20 has the mating portion 21 which is configured to be received in the receiving portion 13 of the connector 10.

The present application is based on a Japanese patent applications of JP2012-020182 filed before the Japan Patent Office on Feb. 1, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on a circuit board and matable with a mating connector having a mating portion and a mating shell, the connector comprising:

a receiving portion which is adapted to receive the mating portion of the mating connector when the mating portion is inserted into the connector toward a rear end of the connector in a front-to-rear direction;

a plurality of contacts;

a housing having a holding portion and two end portions, the holding portion holding the contacts so that the contacts are arranged in a pitch direction perpendicular to the front-to-rear direction, the holding portion having an upper portion and a lower portion in an upper-to-lower direction perpendicular to both the front-to-rear direction and the pitch direction, the upper portion and the lower portion constituting at least a part of the receiving portion, and the end portions being located at opposite ends of the holding portion in the pitch direction, respectively; and a shell having an upper plate portion, a lower plate portion and a plurality of connected portions, the upper plate portion being located at the upper portion of the housing, the lower plate portion being located at the lower portion of the housing, the connected portions comprising a plurality of first connected portions and a plurality of second connected portions, the first connected portions being configured to be connected to the mating shell of the mating connector when the connector and the mating connector are mated with each other, the second connected portions being configured to be connected to the circuit board when the connector is mounted on the circuit board, and the first connected portions and the second connected portions extending forward from the lower plate portion beyond the upper portion.

2. The connector as recited in claim 1, wherein the first connected portions are arranged to intermingle with the second connected portions along the pitch direction, at least one of the connected portions which neighbors each first connected portion in the pitch direction being the second connected portion.

3. The connector as recited in claim 1, wherein the first connected portions and the second connected portions are arranged alternately in the pitch direction.

4. The connector as recited in claim 1, wherein all of the first connected portions and the second connected portions are arranged in a single row in the pitch direction.

5. The connector as recited in claim 1, wherein:

the first connected portion and the second connected portion have a first body portion and a second body portion, respectively; and the first body portion and the second body portion are located below the lower plate portion.

6. The connector as recited in claim 5, wherein the first body portion is provided with a protrusion protruding upward.

7. The connector as recited in claim 5, wherein the first body portion is located above the second body portion.

8. The connector as recited in claim 1, wherein:

the lower plate portion has a front end part formed on a bottom surface thereof, the front end part extending in the pitch direction;

the lower portion of the holding portion is located rearward of the front end part; and the front end part is visible from below.

9. The connector as recited in claim 1, wherein a size of the first connected portion in the pitch direction is smaller than a size of the second connected portion in the pitch direction.

10. The connector as recited in claim 1, wherein the shell is embedded in the housing by insert-molding so that the shell and the housing are integrated.

* * * * *